US005685287A

United States Patent [19]

Greywall

[11] Patent Number: 5,685,287

[45] Date of Patent: Nov. 11, 1997

[54] ARROW REST FOR AN ARCHERY BOW

[76] Inventor: Dennis S. Greywall, 9 S. Ryland Rd., Whitehouse Station, N.J. 08889

[21] Appl. No.: 604,724

[22] Filed: Feb. 21, 1996

[51] Int. Cl.[6] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 3,935,854 | 2/1976 | Troncoso, Jr. | 124/44.5 |
| 4,236,497 | 12/1980 | Troncoso, Jr. | 124/44.5 |
| 4,282,850 | 8/1981 | Warnike | 124/24.1 |
| 4,324,221 | 4/1982 | Peck | 124/44.5 |
| 4,332,232 | 6/1982 | Troncoso, Jr. | 124/44.5 |
| 4,351,311 | 9/1982 | Phares | 124/44.5 |
| 4,372,282 | 2/1983 | Sanders | 124/44.5 |
| 4,421,092 | 12/1983 | Christian | 124/44.5 |
| 4,569,325 | 2/1986 | Christian | 124/44.5 |
| 5,009,215 | 4/1991 | Ludwig | 124/44.5 |
| 5,025,773 | 6/1991 | Hintze et al. | 124/44.5 |
| 5,031,601 | 7/1991 | Gunter | 124/44.5 |
| 5,042,450 | 8/1991 | Jacobson | 124/44.5 |
| 5,085,201 | 2/1992 | Tepper et al. | 124/44.5 |
| 5,095,884 | 3/1992 | Mertens | 124/44.5 |
| 5,144,937 | 9/1992 | Colvin | 124/44.5 |
| 5,251,606 | 10/1993 | Colvin | 124/44.5 |
| 5,253,633 | 10/1993 | Sisko | 124/44.5 |
| 5,261,383 | 11/1993 | Halamay | 124/44.5 |
| 5,385,135 | 1/1995 | Saunders | 124/44.5 |
| 5,456,242 | 10/1995 | Ruholl | 124/44.5 |
| 5,460,152 | 10/1995 | Specht | 124/44.5 |
| 5,462,041 | 10/1995 | Solecki | 124/44.5 |
| 5,529,049 | 6/1996 | Antalosky | 124/44.5 |

*Primary Examiner*—John A. Ricci
*Attorney, Agent, or Firm*—Wayne S. Breyer

[57] ABSTRACT

An improved arrow rest and archery bow are disclosed. The arrow rest has guides for directing an arrow shaft to an arrow support region defined between the guides. Preferably, two adjustable, spring-biased contacts are disposed in the arrow support region for supporting the arrow. The guides allow an archer substantial latitude for initial placement of the arrow shaft on the rest. Furthermore, the guides will return a jarred arrow shaft to the arrow support region. A support structure interconnects the guides with an archery bow.

20 Claims, 2 Drawing Sheets

ARROW REST FOR AN ARCHERY BOW

FIELD OF THE INVENTION

The present invention relates generally to an arrow rest for an archery bow. More particularly, the present invention relates to an arrow rest for positioning the forward end of a nocked arrow shaft in a highly stable shooting position.

BACKGROUND OF THE INVENTION

An archery arrow shaft that is in shooting position on a archery bow is typically supported and positioned at its forward end by a rest. The rest may be constructed as part of the bow or may be formed as a separate device that is attached to the bow near its midpoint. Ideally, the rest should position the shaft in a reproducible manner and should not impede or otherwise alter the flight of the arrow following its release. Furthermore, the portion of the rest that supports the arrow shaft should be pliant or cushioned. Such cushioning is believed to lead to truer arrow flight because it allows for transverse flexing of the arrow shaft following the impulse generated by the release of the bow string.

As an archer draws back on a bow, he may create a transverse force on the arrow shaft. A drawback of many existing bow rests, such as those described in U.S. Pat. Nos. 3,935,854, 5,095,884 and 5,251,606, is that the shaft is supported by two contacts at a position that is only marginally stable. On bows using such bow rests, the transverse force is often sufficient to dislodge the shaft from its delicate equilibrium position on the rest, causing the arrow to fall away. This can be dangerous, as well as result in noise that is a detriment in hunting.

Another drawback of the aforementioned two-point rests is that often only one of the two contacts provides cushioning or the two contacts are locked together and controlled by a single spring or biasing member. Furthermore, the archer must place the arrow shaft directly onto the contacts to position it in proper shooting position.

Arrow rests using three-point contact mechanisms, such as those described in U.S. Pat. Nos. 5,261,383, 5,456,242 and 5,460,152, retain the shaft centering more securely than existing two-point rests. But, such three-point rests undesirably resist the arrow's flight following release due to the clamping action of the three supports. More significantly, the arrow shaft is confined to follow the recoil motion of the bow leading to improper arrow flight.

Thus, there is a need for a rest that does not resist the arrow's flight, that guides the arrow into a proper and stable shooting position and returns the arrow to such a position if it is jarred.

SUMMARY OF THE INVENTION

An improved arrow rest and archery bow are disclosed. The arrow rest comprises guides for directing an arrow shaft to an arrow support region defined between the guides. In preferred embodiments, the guides are configured as opposed inclined surfaces. The guides allow an archer substantial latitude for initial placement of the arrow shalt on the rest; the guides direct the arrow to the proper shooting position in the arrow support region. Furthermore, the guides will return a jarred arrow shaft to the arrow support region. In prior art arrow rests, a jarred arrow shaft will typically have to be repositioned by the archer. In one embodiment, two spring-biased contacts are disposed in the arrow support region for supporting the arrow. A support structure interconnects the guides with an archery bow.

BRIEF DESCRIPTION OF THE DRAWINGS

Further features of the invention will become more apparent from the following detailed description of specific embodiments thereof when read in conjunction with the accompanying drawings, in which like elements have like reference numbers and in which.

DETAILED DESCRIPTION OF THE INVENTION

Figure 1:
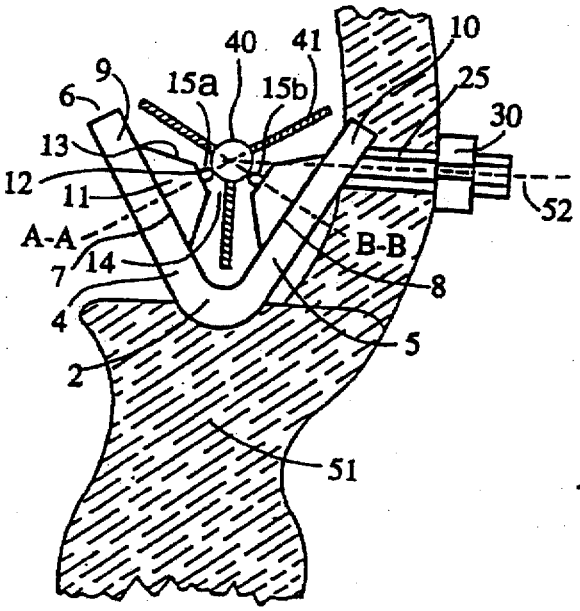
FIG. 1 illustrates an embodiment of the arrow rest of the present invention as viewed along the axis of the arrow shaft.
Figure 2:
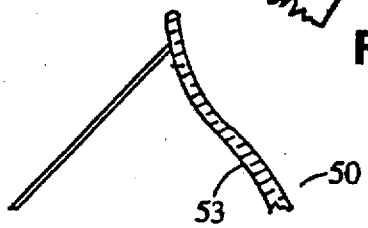
FIG. 2 is a side view the embodiment of FIG. 1.
Figure 2:
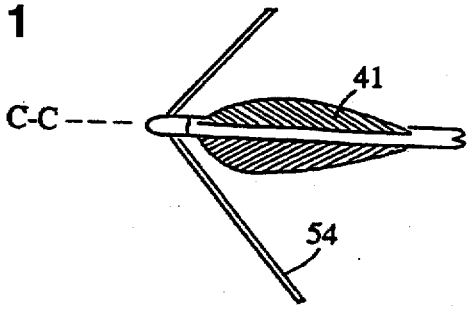
Figure 2:
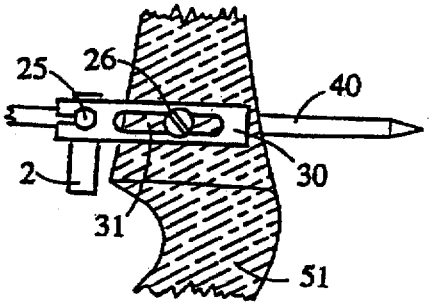
Figure 2:
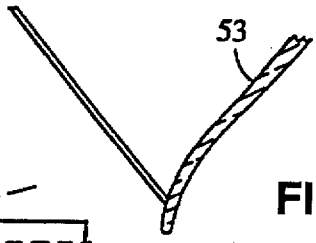

As shown in FIGS. 1 and 2, the arrow rest 1 includes a support structure 6 for supporting two spaced guides 11 that define an arrow support region 14 therebetween. The support structure 6 further serves to interconnect the guides 11 with an archery bow 50. In the embodiment shown in FIGS. 1 and 2, the support structure 6 includes a body piece 2, a support rod 25 depending therefrom and a mounting member 30. The mounting member 30 attaches to the archery bow and receives the support rod 25. As shown in FIG. 2, the archery bow has a pair of recurved limbs 53 interconnected by a handle portion 51. The tips of the limbs 53 are secured to opposite ends of a bowstring 54. The arrow rest is attached to the archery bow 50 above the handle portion 51 and near its mid-point 52.

In the embodiment of FIG. 1, the guides 11, which are triangularly-shaped, are disposed on opposing faces 7 and 8 of arms 4 and 5 of the body piece 2. The surface 13 of the guides 11 is inclined toward the arrow support region 14 so that an arrow shaft 40 placed on the surface 13 will be directed, by gravity, to the arrow support region 14. In a preferred embodiment, opposed contacts **15*a* and 15*b* are located within the arrow support region 14 at the apex or top 12 of the guides 11. The size of the guides and the spacing of the opposing faces 7 and 8 are set so that the contacts 15*a* and 15*b* are suitably spaced from each other to support the forward end of a nocked arrow shaft 40. If the contacts 15*a* and 15*b* are present in the arrow support region 14, the guides preferably direct the arrow shaft 40 onto the contacts. Portions 9 and 10 of the arms 4 and 5, respectively, extending upwardly beyond the guides 11 aid in preventing the arrow shaft 40 from falling-off the arrow rest 1** if the bow is tilted from the vertical.

The contacts **15*a* and 15*b* can be attached to the guides 11. The contacts can be formed of plastic, metal or the like. In one embodiment, the contacts 15*a* and 15*b* are ball-bearings. In a preferred embodiment, each contact 15*a*, 15*b* is disposed on an associated plunging device 17 that provides a spring-biased resilience to the contacts. The plunging devices allow for spring-biased movement of the contact 15***a* along the axis A—A and the contact 15*b* along the axis B—B. In this manner, the transverse forces on the arrow shaft generated by the release of the bowstring are transferred to the contacts 15*a* and 15*b* and the associated plunging devices 17, minimizing deflection of the arrow thereby improving shooting accuracy.

Figure 3:
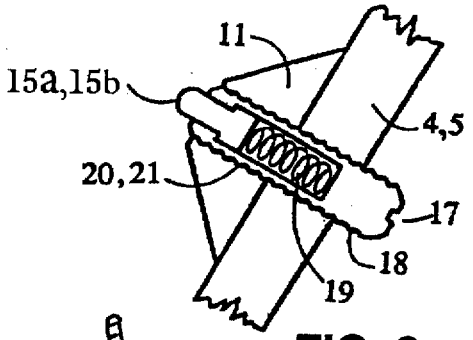
FIG. 3 is an embodiment of a plunging device for providing spring bias to contacts that support the arrow shaft.

In a preferred embodiment shown in FIG. 3, the plunging device 17 comprises a spring 19 disposed within a hollowed-out set screw 18. The contact is attached to the spring 19. Other arrangements may suitably be used. See, for example, U.S. Pat. No. 5,251,606. Each plunging devices 17 is supported by one of the guides 11, as illustrated in FIG. 3. In a presently preferred embodiment, the threads of the set-screw 18 engage complementary threaded openings 20 and 21 through the body piece 2 and the guide 11, respectively. As discussed further later in this specification, the arrow shaft 40 can be raised or lowered by simply threading the plunging devices 17 either further into, or out of, the guides 11. A locking device, not shown, such as a nut, can be threaded on to the end of the plunging devices 17 to ensure that they will not move once positioned within the guides 11.

Figure 4:
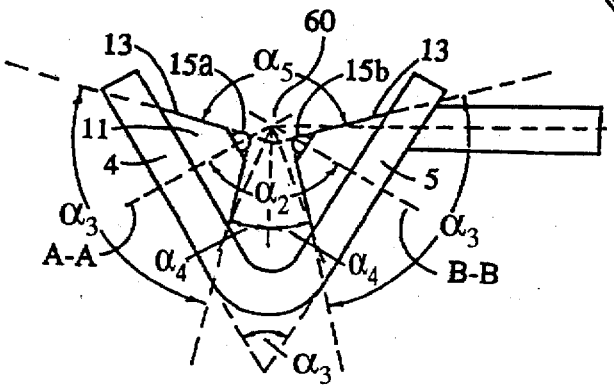
FIG. 4 denotes angles $\alpha_1$–$\alpha_5$ which are indicative of the geometric interrelationship of the various elements of the arrow rest of FIG. 1.

The geometric orientation of the various components comprising the arrow rest 1 of a preferred embodiment is described below in conjunction with FIG. 4. The plunging device 17 associated with the contact 15*a* is aligned along the axis A—A, which is perpendicular to the side 4 of the body piece 2. The plunging device 17 associated with the contact 15*b* is aligned along the axis B—B, which is likewise perpendicular to the side 5 of the body piece 2. The sides 4 and 5 form an angle, $\alpha_1$, with respect to one another of about 60 degrees. Consequently, the contacts 15*a*, 15*b* meet the arrow shaft 40 with an angular separation, $\alpha_2$, of about 120 degrees. With the arrangement of the arrow fletchings 41 shown in FIG. 1, i.e., one of the three fletchings 41 pointing downwardly, each contact 15*a*, 15*b* touches the arrow shaft 40 at a point on the circumference of the arrow shaft midway between fletchings. This arrangement provides maximum clearance for the fletchings. In a further preferred embodiment, the axes A—A and B—B of the plunging devices 17 lie in a plane that is perpendicular to the axis C—C of the arrow shaft. Furthermore, the axes of the plunging devices 17 preferably are directly radially inward toward the axis of the arrow shaft 40.

The guides 11 are preferably triangularly-shaped having a top angle, $\alpha_3$, of about 90 degrees. The surface 13 of each of the guides 11 thus provide a funnel that directs a nocked arrow shaft 40 onto the contacts 15*a* and 15*b*, if present, and into proper shooting position. The angle, $\alpha_4$, between the surface 13 of each of the guides 11 is preferably about 150 degrees. The angular clearance, $\alpha_4$, between either one of the guides 11 and an arrow fletching 41 pointing downwardly as shown in FIG. 1, is about 20 degrees.

If the archer tilts the archery bow 50 from the vertical and the arrow shaft 40 falls off of the contacts 15*a*, 15*b*, the portions 9 and 10 of the body piece 2 will aid in keeping the arrow shaft on the arrow rest 1. As the archer then returns the archery bow 50 to a vertical orientation, the surface 13 of either of the guides 11 will direct the arrow shaft 40 back to the arrow support region 14 and, if present, on to the contacts 15*a*, 15*b*.

It should be appreciated that in other embodiments, the geometric orientation of the elements of the arrow rest may deviate from the above-described preferred embodiment.

As previously mentioned, in a preferred embodiment, the support structure 6 includes a mounting plate 30 for attachment to the archery bow 50, as shown in FIG. 2. The mounting plate 30 is preferably bolted to the archery bow 50 via a mounting bolt 26 that is placed through a slotted hole 31 and threaded into the archery bow 50. The mounting plate 30 receives a support rod 25 depending from the arm 5 of the body piece 2. The support rod 25 and the mounting plate 30 are preferably physically adapted to prevent lateral movement and axial rotation of the support rod 25.

Figure 5:
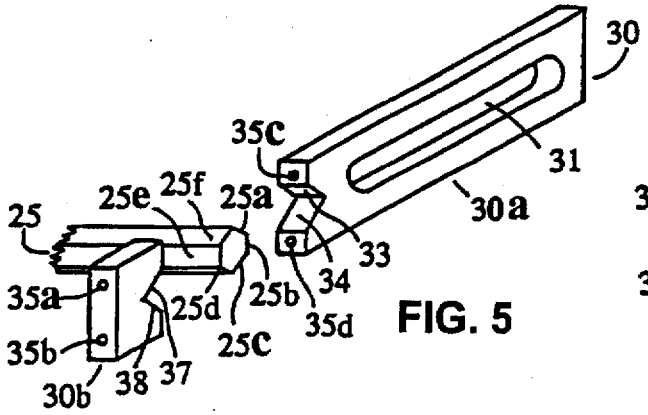
FIG. 5 illustrates an embodiment of a support structure including a body piece, support rod and two-piece mounting plate and support rod clamp.

In a preferred embodiment, the support rod 25 has a hexagonal cross section, so that the perimeter of the rod is characterized by surfaces 25*a*–25*f* as shown in FIG. 5. In one embodiment, the mounting plate 30 comprises a mounting part, 30*a*, and a closure pan 30*b*. The surfaces 25*a* and 25*c* of the support rod 25 are abutted to opposing faces 33 and 34, respectively, which are located at one end of the mounting part 30*a*. The closure part 30*b* is brought into contact with the support rod 25 so that opposing faces 37 and 38 of the closure part abut surfaces 14*f* and 14*d*, respectively. The closure part 30*b* is then attached to the mounting pan 30*a* by a suitable means such as a pair of screws, not shown, which are received by openings 35*a*–35*d*; openings 35*c* and 35*d* being threaded. As the screws are tightened, the support rod is prevented from moving laterally or rotating.

Figure 6:
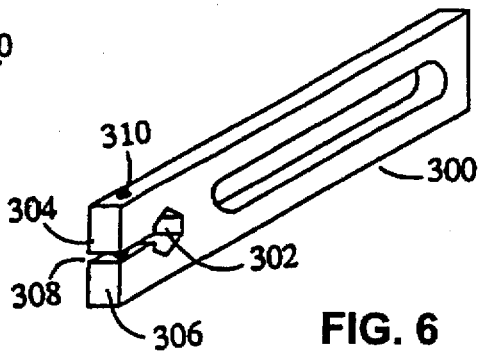
FIG. 6 shows an embodiment of a one-piece mounting plate and support rod clamp.
Figure 7:
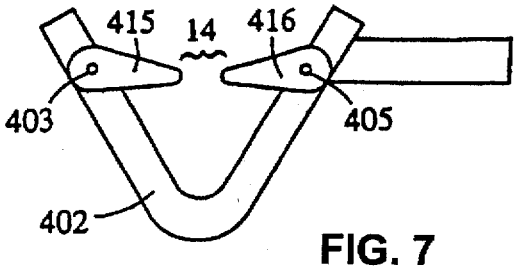
FIG. 7 is a further embodiment of an arrow rest using pivot mounted guides.

In a presently preferred embodiment illustrated in FIG. 6, the support rod 25, again having a preferably hexagonal shape, is received by a hexagonally-shaped opening 302 in a one-piece mounting plate 300. As shown in FIG. 7, five of the six faces of the hexagonally-shaped opening 302 are defined by an interior surface of the mounting plate 300. The sixth face, however, is left open, creating a gap 308 in the mounting plate 300. A bolt or other securing device may be placed through bore 310 in the regions 304 and 306 of the mounting plate, thus forming a clamp. As the bolt is tightened, the regions 304 and 306 are forced toward one another clamping the support rod 25 in place within the opening 302.

It will be appreciated that many other arrangements for suitably preventing the support rod 25 from moving laterally or axially rotating will occur to those skilled in the art and can be used in conjunction with the present invention. The support structure 6 has been described, in preferred embodiments, to comprise separate parts, such as the body piece 2, support rod 25 and mounting plate 30. It should be understood that in other embodiments, the support structure 6 can be configured as a single integrated structure. Other arrangements for suitably supporting the guides and interconnecting them with the archery bow 50 that may occur to those skilled in the art can alternatively be used.

The arrow rest 1 of the present invention can be adjusted as follows to allow for variations in arrow diameter, arrow length, personal preference and the like. Vertical adjustment of the arrow rest 1 can be effected by rotating the mounting plate 30 or 300 about the axis of the single mounting bolt 26. Lateral adjustment of the arrow rest 1 is accomplished by varying the position of the support rod 25 in mounting plate 30 or 300. The slotted hole 31 in the mounting plate 30 or 300 allows the body piece to be adjusted horizontally to accomodate arrow shafts 40 of varying length.

For proper flight, the arrow shaft 40 should be located at the mid-point 52 of the bow 50. The axes of the two plunging devices 17 and the support rod 25 preferably intersect at a common point, designated 60, at the mid-point 52 of the bow 50. By adjusting the position of the contacts 15*a* and 15*b* along the axes A—A and B—B, respectively, such as by threading the plunging devices 17 further into or out of the guides 11, the arrow shaft 40 can be raised or lowered so that its axis passes through the common intersection point 60. This allows the arrow rest 1 to be used with arrow shafts 40 of different diameter without having to readjust the position of the body piece 2.

The body piece 2 and the mounting plate 30 or 300 can be made of metal, plastic or the like. It will be appreciated that certain materials may be better suited to a given embodiment of the present invention. For example, if a one-piece mounting plate 300 is to be used, it is preferable to use a plastic for the material of construction, since a hexagonally-shaped opening can readily be formed in plastic. On the other hand, a metal such as aluminum would be less suitable since such a shape cannot readily be milled in aluminum.

Since the support rod 25 can be received by the mounting plate 30 from either side, the same arrow rest may be used on either a right-handed or a left-handed bow.

It will be appreciated that some of the features of the present invention, such as two-point contact and the guides 11 for positioning the arrow shaft 40 and for preventing the arrow shaft from falling off the contacts can be realized by embodiments other than those described above. FIGS. 7–10 illustrate several non-limiting alternate embodiments of an arrow rest according to the present invention.

In the embodiment illustrated in FIG. 7, spaced pivoting guide members 415 and 416 are attached to a body piece 402 at pivot points 403 and 405, respectively. A biasing spring is located at the pivot points to hold the guide members 415 and 416 in proper position for supporting the arrow shaft 40 in the arrow support region 14 and for allowing the guide members to move downwardly as the bow string is released. The guide members support the arrow shaft 40, as well as functioning as guides to position the arrow shaft 40 in the arrow support region 14 and prevent it from falling off the arrow rest. In a preferred embodiment, the guide members are inclined about 150 degrees apart. The body piece 402 can be attached to a bow 50 via the support rod and mounting plate arrangement described previously.

Figure 8:
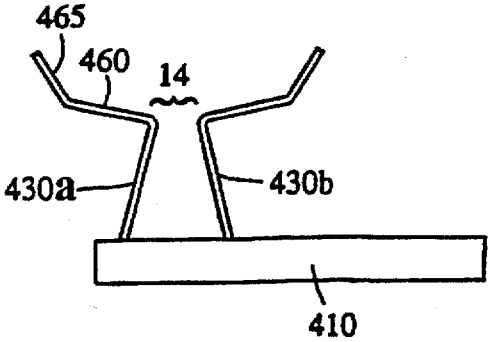
FIG. 8–10 show three additional embodiments of the present arrow rest using rods that serve as a guide, arrow support and provide spring biasing.
Figure 9:
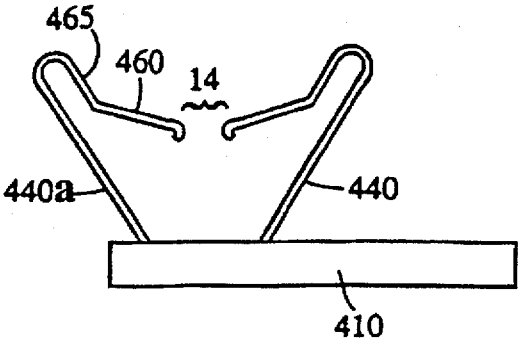
Figure 10:
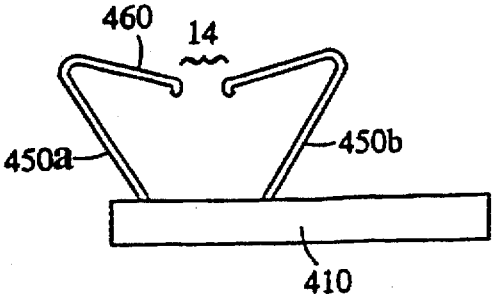

Embodiments of an arrow rest according to the present invention utilizing pairs of opposed bent rods 430*a, b*, 440*a,b* and 450*a, b* are illustrated in FIGS. 8–10, respectively. The rods are suitably spaced to support the arrow shaft 40 at the arrow support region 14. In the embodiments pictured in FIGS. 8–10, a region 460 of each of the rods 430*a,b*, 440*a,b* and 450*a,b* is inclined towards the arrow support region 14. The region 460 functions as a guide for positioning the arrow shaft 40 in the arrow support region 14. In a preferred embodiment, the angle defined between the region 460 of the rods of a pair, such as rods 430*a,b*, 440*a,b* and 450*a,b* is 150 degrees. In a further preferred embodiment illustrated in FIGS. 8 and 9, the rods 430*a,b* and 440*a,b* further comprise a region 465 that projects upwardly relative to the region 460. The region 465 aids in preventing the arrow shaft 40 from falling-off the arrow rest if the bow is tilted from the vertical.

Spring-biased resilience can be supplied by the intrinsic bending moments of the rods. The rods are disposed on a support structure 410. In such embodiments, the support structure 410 can be a support rod similar to the support rod 25 described in previous embodiments. If the rods are supported in this manner, the support rod 410 should positioned below the midpoint 52 of the bow 50. In this manner, the arrow support region 14 can be suitably positioned to align the arrow shaft 40 along the midpoint 52 of the archery bow 50. It is within the capabilities of those skilled in the art to modify the support structure 410 so that the arrow support region 40 is properly positioned. In other embodiments, spring bias can be provided by a support rod designed to rotate about its axis. In such embodiments, the rods that support the arrow shaft 40 would be rotated about 45 degrees from the vertical in the unbiased position.

In preferred embodiments of the present invention, the region or surface of the guide that directs the arrow to the arrow support region 14, such as the region 460 or the surface 13, is about one-half of an inch in length. The preferred embodiment of the present arrow rest 1 has been described as an auxiliary device to be mounted to a conventional archery bow. In an alternate embodiment of the invention, the arrow rest can be incorporated into an archery bow during manufacture.

Other embodiments and variations than those described herein will be apparent to those skilled in the art, and the present invention is therefore limited only by the appended claims.

I claim:

1. An arrow rest for an archery bow, comprising:

two spaced guides defining an arrow support region therebetween, the guides having a surface inclined toward the arrow support region so that an arrow shaft placed on the surface of either of the guides is directed to the arrow support region; and a support structure for supporting the guides and interconnecting them with the archery bow so that the arrow support region is near the midpoint of the archery bow.

2. The arrow rest of claim 1 further comprising two contacts for supporting the arrow shaft in the arrow support region.

3. The arrow rest of claim 2 wherein the contacts are spring biased.

4. The arrow rest of claim 3 wherein each contact is attached to a plunging device located within the guides.

5. The arrow rest of claim 1 wherein the support structure comprises a body piece having a first and second arm inclined towards each other collectively forming a "v" shape, wherein one of the guides is disposed on the first arm and the second guide is disposed on the second arm.

6. The arrow rest of claim 5 wherein the guides have a trapezoidal shape.

7. The arrow rest of claim 6 further comprising two contacts for supporting the arrow shaft in the arrow support region, wherein one contact is disposed at the apex of each of the guides.

8. The arrow rest of claim 7 wherein each contact is attached to a plunging device located within each guide, wherein each plunging device is aligned along an axis perpendicular to the arm on which the guide is disposed.

9. The arrow rest of claim 8 wherein the axes intersect at the midpoint of the archery bow.

10. The arrow rest of claim 8 wherein the plunging device is adjustable along the axis.

11. The arrow rest of claim 5 wherein the guides are disposed on the arms so that a portion of each arm is located above the respective guide.

12. The arrow rest of claim 5 wherein the support structure further comprises:

a support rod depending from one of the arms of the body piece; and a mounting plate for attachment to the archery bow and for receiving the support rod.

13. The arrow rest of claim 12 wherein the support rod is hexagonally-shaped and the mounting plate has a hexagonally-shaped opening for receiving the support rod.

14. The arrow rest of claim 1 wherein the guides are pivotally-attached to the support structure.

15. The arrow rest of claim 1 wherein the guides comprise two bent rods.

16. An archery bow having a midpoint located above a handle, comprising:

a pair of recurred limbs interconnected by the handle, a first end of each of the limbs being physically adapted to be secured to a bowstring; and an arrow rest for directing the forward end of an arrow shaft into a proper shooting position, the arrow rest positioned above the handle and near the midpoint, the arrow rest having two spaced guides defining an arrow support region therebetween, the guides having a surface inclined toward the arrow support region so that an arrow shaft placed on the surface of either of the guides is directed to the arrow support region; and a support structure for supporting the guides, which support structure is attached to one of the limbs near the handle.

17. The arrow rest of claim 16 further comprising two contacts for supporting the arrow shaft in the arrow support region.

18. The arrow rest of claim 17 wherein the contacts are spring biased.

19. The arrow rest of claim 18 wherein each contact is attached to a plunging device located within the guides.

20. The arrow rest of claim 18 wherein the support structure comprises a body piece having a first and second arm inclined towards each other collectively forming a "v" shape, wherein one of the guides is disposed on the first arm and the second guide is disposed on the second arm.

* * * * *